United States Patent [19]

Gerstmann

[11] Patent Number: 4,471,907

[45] Date of Patent: Sep. 18, 1984

[54] VENTURI PRESSURIZER FOR INCOMPRESSIBLE-LIQUID CIRCULATING SYSTEMS

[75] Inventor: Joseph Gerstmann, Framingham, Mass.

[73] Assignee: Amtrol Inc., West Warwick, R.I.

[21] Appl. No.: 264,554

[22] Filed: May 18, 1981

Related U.S. Application Data

[63] Continuation-in-part of Ser. No. 44,585, Jun. 1, 1979, abandoned.

[51] Int. Cl.[3] ..... F24D 3/00

[52] U.S. Cl. ..... 237/65; 237/56; 237/66; 137/565

[58] Field of Search ..... 237/59, 56, 8 R, 66, 237/65; 137/565

[56] References Cited

U.S. PATENT DOCUMENTS

| | | | |
|---|---|---|---|
| 566,904 | 9/1896 | Gold . | |
| 667559 | 2/1901 | Neubauer . | |
| 1,278,067 | 9/1918 | MacDonald . | |
| 1,418,583 | 6/1922 | Lincke . | |
| 1,472,931 | 11/1923 | Morison . | |
| 2,077,612 | 4/1937 | Besag . | |
| 2,265,108 | 12/1941 | Berman . | |
| 2,343,486 | 3/1944 | Stepanoff . | |
| 2,404,114 | 7/1946 | Waterman . | |
| 2,677,389 | 5/1954 | Jisha et al. . | |
| 2,843,142 | 7/1958 | Gardner . | |
| 2,901,176 | 8/1959 | Hoyt . | |
| 3,195,294 | 7/1965 | Verdura et al. | 237/66 |
| 3,274,065 | 9/1966 | Kierulf et al. . | |
| 3,554,441 | 1/1971 | Gunnar et al. . | |
| 3,614,266 | 10/1971 | Clampa et al. . | |
| 3,730,646 | 5/1973 | Affri et al. . | |
| 3,987,628 | 10/1976 | Gassman . | |

FOREIGN PATENT DOCUMENTS

| | | | |
|---|---|---|---|
| 1164060 | 9/1964 | Fed. Rep. of Germany | 237/8 R |
| 2705721 | 9/1977 | Fed. Rep. of Germany . | |
| 211287 | 2/1924 | United Kingdom . | |
| 415350 | 8/1934 | United Kingdom | 237/66 |
| 1386387 | 3/1975 | United Kingdom | 237/8 R |
| 756142 | 8/1980 | U.S.S.R. | 237/66 |

OTHER PUBLICATIONS

Walker et al., "Principles of Chemical Engineering", 3rd Ed., (1937), pp. 68 to 70.

Perry, "Chemical Engineers' Handbook", 3rd Ed., (1950), pp. 401, 406 and 407.

Badger et al., "Introduction to Chemical Engineering", (1955), pp. 55 and 56.

Ebertshauser, H., "Bauelemente der Olhydraulik", Part 1, Krausskopf-Verlag, Mainz, (1974), p. 255.

Chaimowitsch, E. M., "Olhydraulik, Grundlagen und Anwendung", VEB-Verlag Technik, Berlin, (1961), pp. 89 and 90.

Zoebl, Heinz, "Olhydraulik", Springer-Verlag, Wien, (1963), p. 106.

*Primary Examiner*—Albert J. Makay

*Assistant Examiner*—Henry Bennett

*Attorney, Agent, or Firm*—Fisher, Christen & Sabol

[57] ABSTRACT

A closed-loop, incompressible-liquid circulating, hydronic heating system, for instance, a hot water heating system, which utilizes a Venturi-type control device to effect communication between the circulating hydronic heating system and a storage tank. The storage tank, which is maintained at ambient atmospheric pressure, is connected to the throat of the Venturi. The inlet and outlet of the Venturi are connected to the pump outlet and inlet, respectively, in parallel with the main circulating loop. The Venturi control device automatically controls the pressure in the circulating system by means of controlling the flow of incompressible-liquid between the storage tank and the incompressible-liquid circulating system. The Venturi control device responds automatically to changes of pressure in the circulating system. The pressure differential between the Venturi throat and the Venturi inlet remains constant. Thus, if the Venturi throat pressure is set so as to be at or near atmospheric during normal operating conditions of the circulating system, when the pressure of the circulating system drops, the Venturi throat pressure will drop below atmospheric and draw incompressible liquid (e.g., water) from the storage tank into the circulating system. Conversely, if the pressure in the circulating system should rise, the Venturi throat pressure would rise above its ambient atmospheric level to thereby vent some of the water from the circulating system back into the storage tank.

18 Claims, 4 Drawing Figures

| | $P_1$-ATM | $P_2$-ATM | $P_3$-ATM |
|---|---|---|---|
| CIRC ON | 2.0 | 0 | 1.7 |
| CIRC OFF | 0 | 0 | 0 |

FIG 3
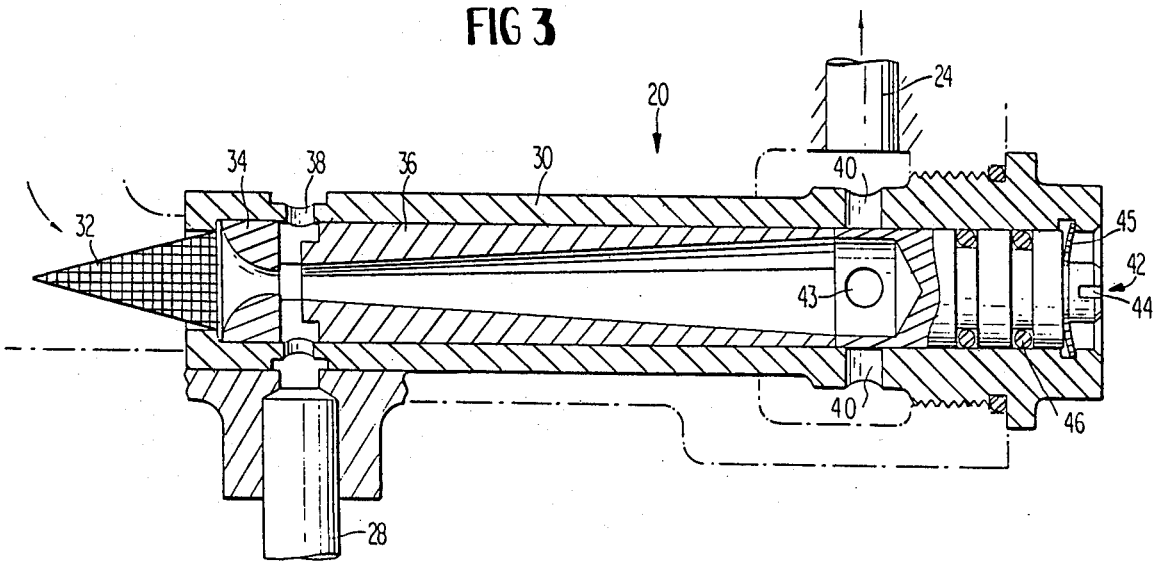
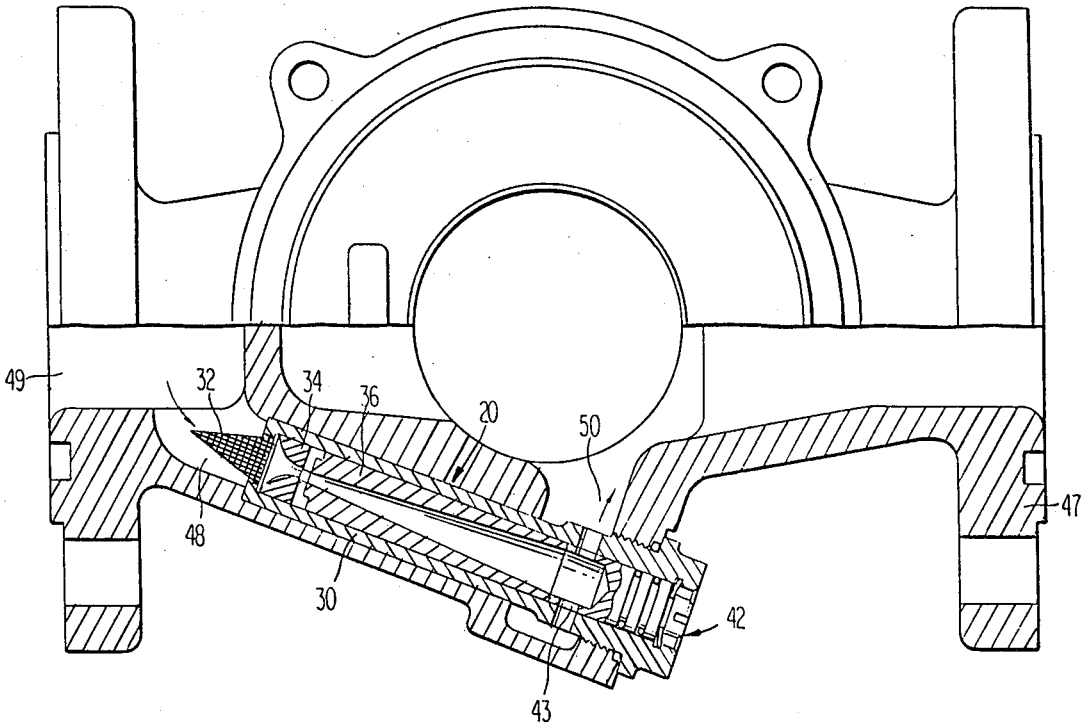
FIG 4

VENTURI PRESSURIZER FOR INCOMPRESSIBLE-LIQUID CIRCULATING SYSTEMS

This is a continuation-in-part of U.S. application Ser. No. 44,585, filed on June 1, 1979 now abandoned.

BACKGROUND OF THIS INVENTION

1. Field of this Invention

This invention is related to pressure control means for closed-loop, incompressible-liquid circulating, hydronic heating systems.

2. Description of the Prior Art

In all closed liquid circulating systems, some means must be provided to accommodate the expansion and contraction of the liquid within the circulating system, which usually results from thermal expansion of the contained liquid. Typically, this means has a pressurized accumulator tank connected to the circulating system such that when the liquid expands, a portion of it passes into the accumulator tank to prevent undue pressure buildup within the circulating system. The accumulator tank also provides a small supply of liquid to the circulating system when the liquid in the circulating system cools to prevent air from entering the circulating system and to provide a more consistent heat transfer. In the past, such circulating systems have required the accumulator tank to be pressurized, since the liquid within the circulating system itself is also pressurized. The requirement of a pressurized vessel has increased the cost and complexity of such liquid circulating systems and has increased the maintenance requirements due to the need for inspecting the pressurized vessel and its associated components.

The use of a Venturi structure in a water circulating system is known in the art, and is specifically shown in U.S. Pat. No. 2,265,108. The patent, however, utilizes the Venturi structure interconnected between a storage tank, a heater and an incoming water supply such that the action of the incoming water sypply passing through the Venturi creates a low pressure area at the Venturi throat which serves to stimulate the circulation of the water from the storage tank. Thus, the patent utilizes the Venturi structure as a jet-pump device to assist the circulation of the water within the fluid system.

The use of an ejector or jet-pump structure to circulate water through a system, or assist in such circulation, is well-known and is shown by the following U.S. Pat. Nos. 566,904, 1,418,583, 2,404,114, 2,843,142, 3,274,065 and 3,730,646. However, in none of these patents is there a disclosure that a Venturi structure can be interposed between an open storage tank and a closed liquid circulating system such that the liquid circulating means passes a portion of the liquid through the Venturi to control the addition or venting of liquid between the pressurized system and the atmospheric storage tank to control pressure.

It is also known to utilize a water storage tank open to atmospheric pressure in a liquid circulating system, as shown in U.S. Pat No. 3,554,441. The storage vessel is connected to the liquid circulating system so as to allow water to flow into and out of the system depending upon the relative difference between the system pressure and the pressure in the vessel. Overflow of this vessel is prevented by interconnecting it with a secondary storage vessel located at a lower level.

U.S. Pat. No. 667,559 discloses a closed loop fluid circulating system having a pump. The patent has apparatus that contains a Venturi tube, but the flow pattern is into the diffuser and then out of the nozzle. The diffuser relatively slowly causes a decrease in pressure and then the fluid literally explodes out of the narrow end of the nozzle into the rapidly expanding nozzle. This action is not that of a Venturi tube, but is certainly the effective mixing scheme which the patent seeks. The patent deals with a method of adding liquid from a reservoir to a steam boiler. In a steam boiler pressure is governed by the temperature of the steam, which in turn is affected by the amount of heat addition. Steam pressure cannot be controlled by changing the liquid inventory. Also, the patent does not control the pressure in the circulating system by means of the Venturi tube.

U.S. Pat. No. 3,614,266 deals with an oil pump for a car power steering system. The patent does not disclose a Venturi tube and only teaches a nozzle without any diffuser.

German OS No. 2,948,029 and U.S. Pat. No. 3,987,628 (Gassman) deal with a charge pump augmenting device for hydraulic systems of motor vehicles. The concept of Gassman is to augment fluid flow by supplying fluid from a fluid reservoir to maintain a predetermined pressure at the main pumps. But Gassman does not control the pressure by allowing flow both from and to the separate reservoir via the Venturi. Gassman prevents the flow of fluid from the Venturi chamber to the reservoir. There is return fluid flow to the fluid reservoir in Gassman, but it is via a line which is not associated in any way with the Venturi. Gassman's system is not a closed-loop circulating system as all of the return flow is to the reservoir. Gassman uses control and check valves to obtain pressure control.

BROAD DESCRIPTION OF THIS INVENTION

An object of this invention is to provide a simple and reliable means to automatically control the pressure in a closed-loop, incompressible-liquid circulating, hydronic heating system by means of controlling the flow of the incompressible liquid, such as, water, between a storage tank and the closed-loop, incompressible-liquid circulating, hydronic heating system, such means being responsive to changes in the pressure within the circulating system. Another objective of this invention is to provide a pressurized, incompressible-liquid circulating, hydronic heating system which eliminates the pressurized accumulator tank structure. A further objective of this invention is to provide means for automatically adding or venting incompressible liquid from a pressurized incompressible-liquid flow system. An additional objective of this invention is to provide a Venturi structure to control the addition or venting of incompressible liquid from an incompressible-liquid flow system. A further objective is to provide a means to add or vent incompressible liquid from an incompressible-liquid flow system which eliminates the necessity for a separate fill control valve and the resultant complexities inherent in such valve structure. Other objects and advantages of this invention are set out herein or obvious herefrom to one ordinarily skilled in the art.

The objects and advantages of this invention are achieved by the apparatus and process of this invention.

This invention involves a means for controlling the addition and venting of an incompressible liquid between a storage tank, open to the atmosphere, and a closed-loop, incompressible-liquid circulating, hydronic heating system. The means to accomplish this includes a Venturi connected to the incompressible-liquid circulating pump in parallel with the main flow loop such that the Venturi inlet communicates with the pump outlet while the outlet of the Venturi communicates with the pump inlet. The throat of the Venturi is connected to the storage tank and is normally at the same pressure as the storage tank (plus any hydrostatic head due to elevation) such that no flow takes place between the tank and the circulating system during normal conditions. A small amount of incompressible liquid from the pump outlet circulates through the Venturi and back into the pump inlet. The amount of incompressible liquid circulating through the Venturi is relatively small and does not interfere with the adequate functioning of the remainder of the circulating system.

The Venturi automatically controls the pressure in the circulating system by means of controlling the flow of incompressible liquid between the storage tank and the incompressible-liquid circulating, hydronic heating system. The Venturi control device responds automatically to changes of pressure in the closed-loop circulating system.

The pressure differential between the incompressible liquid at the Venturi inlet and at the Venturi throat is fixed due to the design of the Venturi. Thus, if the pressure increases in the closed-loop circulating system, and consequently at the Venturi inlet, the pressure at the Venturi throat will also increase to maintain a constant pressure differential. Once the throat pressure rises above atmospheric, a portion of the incompressible liquid will pass from the closed-loop circulating system through the Venturi throat and into the storage tank, which is open to atmospheric pressure. Conversely, if the pressure of the incompressible liquid within the closed-loop circulating system falls, the pressure at the Venturi throat also drops to below ambient atmospheric, thereby forcing incompressible liquid to flow from the storage tank, into the Venturi throat and subsequently into the closed-loop, incompressible-liquid circulating, hydronic heating system.

Thus, it can be seen that the Venturi control device, according to this invention, provides a simple and reliable means to automatically control the pressure in a closed-loop, incompressible-liquid circulating, hydronic heating system by means of controlling fluid flow between a storage tank and the closed-loop circulating system, and is responsive to changes in the pressure within the incompressible-liquid circulating system.

As used herein, the phrase "incompressible liquids" includes water, propylene glycol, ethylene glycol and mixtures thereof.

BRIEF DESCRIPTION OF THE DRAWINGS

In the drawings:

FIG. 3 is a longitudinal cross-section of the Venturi shown in FIG. 1; and FIG. 4 is a partial sectional view of a pump housing incorporating the Venturi structure shown in FIG. 3.

DETAILED DESCRIPTION OF THE PREFERRED EMBODIMENT

Figure 1:
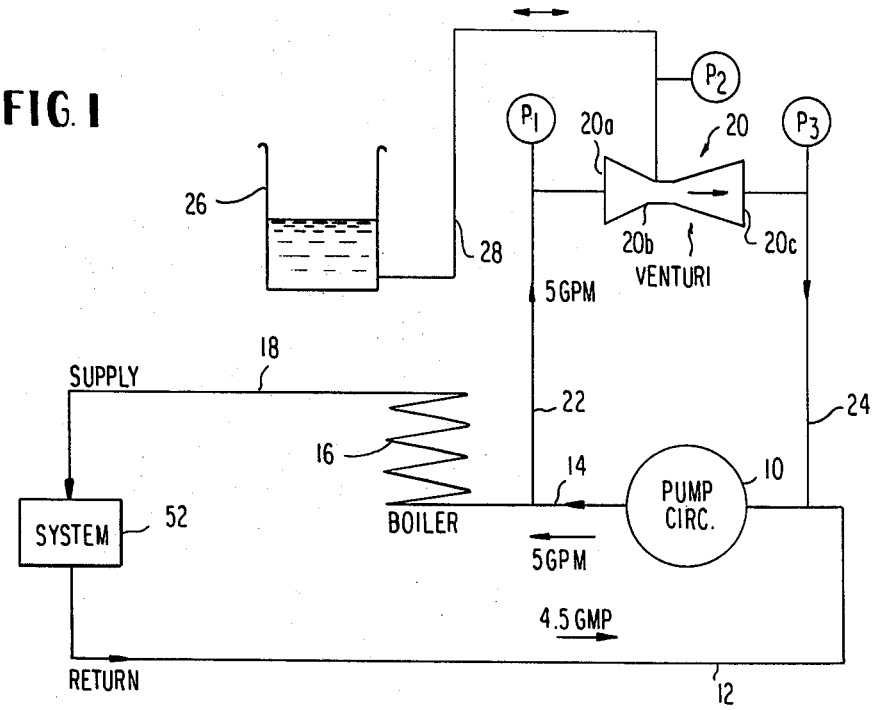
FIG. 1 is a schematic diagram of the closed-loop, incompressible-liquid circulating, hydronic heating system including the Venturi pressurizer according to this invention.

The closed-loop, incompressible-liquid flow control system according to this invention is schematically shown in FIG. 1 and includes pump or other incompressible-liquid circulating means 10 having its inlet connected to return line 12 and its outlet communicating with outlet line 14. For the purpose of explaining this invention, it is assumed that the closed-loop, incompressible-liquid flow system is a hydronic heating system which utilizes water as the incompressible-liquid circulating medium, but any incompressible liquid can be used.

Outlet line 14 transmits the water from pump 10 to boiler 16 in which the water is heated and thereafter is passed to the remainder of the circulating system (box 52) via line 18. The remainder of the circulating system (box 52) can be a series of heat radiating devices to transfer heat from the water to an enclosed space. After giving up its heat, the water returns to pump 10 via return line 12.

Venturi 20, having inlet 20*a*, throat 20*b* and exit 20*c*, is connected to circulating system 52 via conduits 22 and 24 such that a small portion of the water exiting the pump outlet passes into inlet 20*a*, while the water exiting from exit 20*c* returns to pump 10 via line 24. Throat 20*b* is connected to water storage tank 26 via conduit 28. Since storage tank 26 is open to atmospheric pressure, the pressure at the Venturi throat is also at atmospheric pressure such that, under normal operating conditions, no water transfer takes place between storage tank 26 and circulating system 52. The design of Venturi 20 is such that there is a constant pressure differential between the fluid pressure at inlet 20*a* and the fluid pressure at throat 20*b*.

Figure 2:
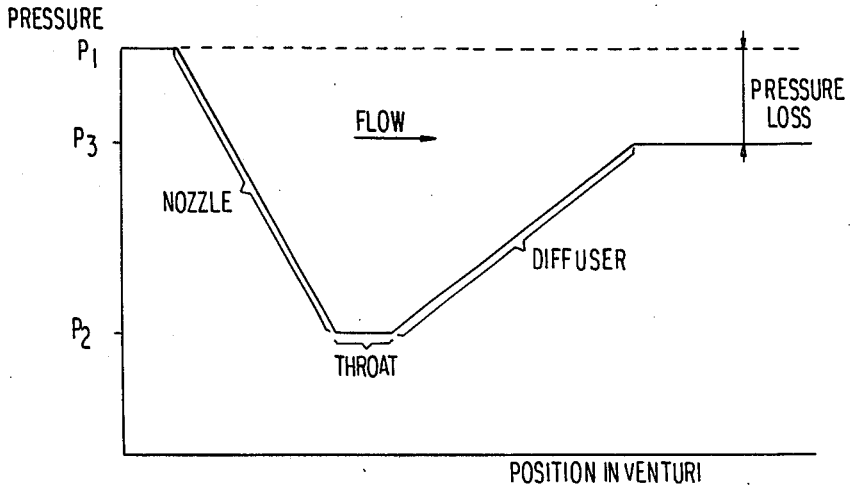
FIG. 2 is a graph of the pressure at various points along the longitudinal axis of the Venturi shown in FIG. 1.

The pressures at the inlet, throat and exit, designated P1, P2 and P3 respectively, are diagrammatically shown in FIG. 2. The difference between pressure P1 and P3 is due to frictional losses as the water passes through Venturi 20. The pressure differential between pressure P1 and pressure P2 remains constant, thus as the pressure in the circulating system (P1) either increases or decreases, the Venturi throat pressure (P2) correspondingly increases or decreases. Thus, as the pressure within the water flow system increases, due to increasing temperature or various other factors, the pressure at Venturi throat 20*b* correspondingly increases. Such increase in pressure P2 creates a pressure differential between Venturi throat 20*b* and storage tank 26, which remains at atmospheric pressure. Such pressure differential causes water to pass from circulating system 52 into storage tank 26 via line 28. This provides the requisite venting of the water flow system to prevent a pressure buildup which may cause malfunctions and, in the extreme case, rupture of the water flow system.

A similar action takes place when the pressure within the water flow system (P1) decreases, since the corresponding decrease in Venturi throat pressure (P2) causes the Venturi throat pressure to decrease below its normal atmospheric pressure thereby creating a pressure bias in favor of storage tank 26. Water from storage tank 26 passes into circulating system 52 via line 28, Venturi 20 and line 24. Such provides the automatic addition of water to circulating system 52 to prevent damage or malfunction.

Thereby, Venturi 20 automatically controls the pressure in circulating system 52 by means of controlling the flow of water between storage tank 26 and circulating system 52. Venturi control device 20 responds automatically to changes in pressure in circulating system 52.

Venturi 20 is shown in detail in FIG. 3 and includes housing 30 which has filter screen 32 attached to its inlet end. Nozzle 34 and diffuser 36 are contained within housing 30. The area between nozzle 34 and diffuser 36 forms throat portion 20*b* of Venturi 20. Throat portion 20*b* communicates with line 28 via a plurality of openings 38 in housing 30. Housing 30 also has two outlet ports 40 which communicate with water circulating system 52 via line 24 to allow the water to flow back into the pump inlet. A valve mechanism, indicated generally at 42, is provided adjacent the exit end of Venturi 20 to control the amount of water that flows through Venturi 20. A change in the alignment of the two sets of ports 40 and 43 by means of screwdriver slot 44 in valve mechanism 42 allows adjustment of the flow through Venturi 20 and, consequently, the adjustment of the pressure in circulating system 52.

Screen 32, nozzle 34, diffuser 36 and valve 42 are held in place by bowed snap ring 45. Sealing means in the form of rubber "O" ring 46 are provided on valve 42.

Venturi 20 shown in FIG. 3 can be attached externally to circulating system 52 via separate conduits 22 and 24 as indicated in the schematic diagram of FIG. 1, or it can be integrated into pump housing 47 as shown in FIG. 4. In such case, pump housing 47 is fabricated having passageway 48 therein which, at one end, communicates with pumpt outlet passage 49 and, at or near its opposite end, communicates with pump inlet 50. Housing 30, containing the elements previously described in reference to FIG. 3, is located in this passageway in the orientation shown in FIG. 4. This installation provides a compact pump/control device structure without the necessity of external piping and plumbing. Although a particular orientation of Venturi 20 is shown in FIG. 4, it is understood that any orientation that is practical and which allows Venturi inlet 20*a* to communicate with the pump outlet and Venturi outlet 20*c* to communicate with the pump inlet is within the scope of this invention.

The foregoing description is intended to only be illustrative of this invention and various modifications can be made thereto without exceeding the scope of the appended claims or this invention.

What is claimed is:

1. In a closed-loop, incompressible-liquid circulating, hydronic heating system having a pump or the like to circulate incompressible liquid through the circulating system, the pump having a housing, an inlet and an outlet, and an incompressible-liquid storage tank to store the incompressible liquid at atmospheric pressure, the improvement comprising Venturi tube means containing a nozzle portion, a throat portion and a diffuser portion, a portion of the incompressible liquid from the pump outlet passing first through the nozzle portion of the Venturi tube means, next through the throat portion of the Venturi tube means, then through the diffuser portion of the Venturi tube means and finally returning to the circulating system upstream of the pump inlet, the Venturi tube means being connected to the circulating system and to the storage tank at the mouth of the Venturi tube means to control the pressure in the circulating system by means of controlling the flow of the incompressible liquid between the storage tank and the circulating system such that when the pressure of the incompressible liquid within the circulating system falls below a predetermined value, incompressible liquid flows into the circulating system from the storage tank through the Venturi tube means, and when the fluid pressure of the incompressible liquid in the circulating system rises above a predetermined value, incompressible liquid flows from the circulating system into the storage tank through the Venturi tube means.

2. In a closed-loop, incompressible-liquid circulating, hydronic heating system having a pump or the like to circulate incompressible liquid through the circulating system, the pump having a housing, an inlet and an outlet, and an incompressible-liquid storage tank to store the incompressible liquid at atmospheric pressure, the improvement comprising Venturi tube means containing a nozzle portion, a throat portion and a diffuser portion, the Venturi tube being located within the pump housing, a portion of the incompressible liquid from the pump outlet passing first through the nozzle portion of the Venturi tube means, next through the throat portion of the Venturi tube means, then through the diffuser portion of the Venturi tube means and finally returning to the circulating system upstream of the pump inlet, the Venturi tube means being connected to the circulating system and to the storage tank to control the pressure in the circulating system by means of controlling the flow of the incompressible liquid between the storage tank and the circulating system such that when the pressure of the incompressible liquid within the circulating system falls below a predetermined value, incompressible liquid flows into the circulating system from the storage tank through the Venturi tube means and when the fluid pressure of the incompressible liquid in the circulating system rises above a predetermined value, incompressible liquid flows from the circulating system into the storage tank through the Venturi tube means.

3. In a closed-loop, incompressible-liquid circulating, hydronic heating system having a pump or the like to circulate incompressible liquid through the circulating system, the pump having a housing, an inlet and an outlet, and an incompressible-liquid storage tank to store the incompressible liquid at atmospheric pressure, the improvement comprising Venturi tube means containing a nozzle portion, a throat portion and diffuser portion, a portion of the incompressible liquid from the pump outlet passing first through the nozzle portion of the Venturi tube means, next through the throat portion of the Venturi tube means, then through the diffuser portion of the Venturi tube means and finally returning to the circulating system upstream of the pump inlet, the Venturi tube means being connected to the circulating system and to the storage tank to control the pressure in the circulating system and to the storage tank to control the pressure in the circulating system by means of controlling the flow of the incompressible liquid between the storage tank and the circulating system such that when the pressure of the incompressible liquid within the circulating system falls below a predetermined value, incompressible liquid flows into the circulating system from the storage tank through the Venturi tube means, and when the fluid pressure of the incompressible liquid in the circulating system rises above a predetermined value, incompressible liquid flows from the circulating system into the storage tank through the Venturi tube means, the normal pressure in the throat of the Venturi tube means being equal to the pressure in the storage tank plus any hydrostatic heat due to the storage tank being at a higher elevation than the throat of the Venturi tube means.

4. In a closed-loop, incompressible-liquid circulating, hydronic heating system having a pump or the like to circulate incompressible liquid through the circulating system, the pump having a housing, an inlet and an outlet, and an incompressible-liquid storage tank to store the incompressible liquid at atmospheric pressure, the improvement comprising the incompressible liquid being water, and Venturi tube means containing a nozzle portion, a throat portion and a diffuser portion, a portion of the incompressible liquid from the pump outlet passing first through the nozzle portion of the Venturi tube means, next through the throat portion of the Venturi tube means then through the diffuser portion of the Venturi tube means and finally returning to the circulating system upstream of the pump inlet, the Venturi tube means being connected to the circulating system and to the storage tank to control the pressure in the circulating system by means of controlling the flow of the incompressible liquid between the storage tank and the circulating system such that when the pressure of the incompressible liquid within the circulating system falls below a predetermined value, incompressible liquid flows into the circulating system from the storage tank through the Venturi tube means, and when the fluid pressure of the incompressible liquid in the circulating system rises above a predetermined value, incompressible liquid flows from the circulating system into the storage tank through the Venturi tube means.

5. Process for controlling the pressure in a closed-loop, incompressible-liquid circulating, hydronic heating system having a pump or the like to circulate incompressible liquid through the circulating system, the pump having a housing, an inlet and an outlet, an incompressible-liquid storage tank to store the incompressible liquid at atmospheric pressure, and Venturi tube means containing a nozzle portion, a throat portion and diffuser portion, a portion of the incompressible liquid from the pump outlet passing first through the nozzle portion of the Venturi tube means, next through the throat portion of the Venturi tube means, then through the diffuser portion of the Venturi tube means and finally returning to the circulating system upstream of the pump inlet, the Venturi tube means being connected to the circulating system and to the storage tank, comprising using said Venturi tube means to control the pressure in the circulating system by means of controlling the flow of the incompressible liquid between the storage tank and the circulating system such than when the pressure of the incompressible liquid within the circulating system falls below a predetermined value, incompressible liquid flows into the circulating system from the storage tank through the Venturi tube means and when the fluid pressure of the incompressible liquid in the circulating system rises above a predetermined value, incompressible liquid flows from the circulating system into the storage tank through the Venturi tube means.

6. In a closed-loop, incompressible-liquid circulating, hydronic heating system having a pump or the like to circulate incompressible liquid through the circulating system, the pump having a housing, an inlet and an outlet, and an incompressible-liquid storage tank to store the incompressible liquid at atmospheric pressure, the improvement comprising Venturi tube means containing a nozzle portion, a throat portion and a diffuser portion, the Venturi tube being located within a passage formed integrally with the pump housing, a portion of the incompressible liquid from the pump outlet passing first through the nozzle portion of the Venturi tube means, next through the throat portion of the Venturi tube means, then through the diffuser portion of the Venturi tube means and finally returning to the circulating system upstream of the pump inlet, the Venturi tube means being connected to the circulating system and to the storage tank to control the pressure in the circulating system by means of controlling the flow of the incompressible liquid between the storage tank and the circulating system such that when the pressure of the incompressible liquid within the circulating system falls below a predetermined value, incompressible liquid flows into the circulating system from the storage tank through the Venturi tube means and when the fluid pressure of the incompressible liquid in the circulating system rises above a predetermined value, incompressible liquid flows from the circulating system into the storage tank through the Venturi tube means.

7. The improved incompressible-liquid circulating system as claimed in claim 2 further comprising valve means to control the amount of incompressible liquid passing through the Venturi tube.

8. The improved incompressible-liquid circulating system as claimed in claim 7 wherein said valve means is located within a Venturi tube housing.

9. The improved incompressible-liquid circulating system as claimed in claims 2, 7 or 8 wherein said storage tank is connected to the Venturi tube at the Venturi throat.

10. The improved incompressible-liquid circulating system as claimed in claim 9 wherein the incompressible fluid is water.

11. The improved incompressible-liquid circulating system as claimed in claim 2 wherein said Venturi tube is located within a passage formed integrally with said pump housing, said storage tank is connected to said Venturi tube at the Venturi throat, and includes valve means to control the amount of incompressible liquid passing through said Venturi tube.

12. The improved incompressible-liquid circulating system as claimed in claim 3 wherein the incompressible liquid is water.

13. The improved incompressible-liquid circulating system as claimed in claim 5 wherein the incompressible liquid is water.

14. The improved incompressible-liquid circulating system as claimed in claim 6 further comprising valve means to control the amount of incompressible liquid passing through the Venturi tube.

15. The improved incompressible-liquid circulating system as claimed in claim 14 wherein said valve means is located within a Venturi tube housing.

16. The improved incompressible-liquid circulating system as claimed in claim 6 wherein said storage tank is connected to the Venturi tube at the Venturi throat.

17. The improved incompressible-liquid circulating system as claimed in claim 6 wherein the incompressible fluid is water.

18. The improved incompressible-liquid circulating system as claimed in claim 6 wherein said storage tank is connected to said Venturi tube at the Venturi throat, and includes valve means to control the amount of incompressible liquid passing through said Venturi tube.

* * * * *